US008129308B2

(12) United States Patent
Oguma et al.

(10) Patent No.: US 8,129,308 B2
(45) Date of Patent: Mar. 6, 2012

(54) THERMAL TRANSFER IMAGE-RECEIVING SHEET AND SURFACE CONDITION IMPROVER

(75) Inventors: Kazuaki Oguma, Kanagawa (JP); Yasufumi Nakai, Tokyo (JP)

(73) Assignee: Fujifilm Corporation, Tokyo (JP)

( * ) Notice: Subject to any disclaimer, the term of this patent is extended or adjusted under 35 U.S.C. 154(b) by 1013 days.

(21) Appl. No.: 12/057,519

(22) Filed: Mar. 28, 2008

(65) Prior Publication Data

US 2009/0011154 A1 Jan. 8, 2009

(30) Foreign Application Priority Data

Mar. 30, 2007 (JP) ..... 2007-092502

(51) Int. Cl.
*B41M 5/035* (2006.01)
*B41M 5/50* (2006.01)

(52) U.S. Cl. ..... 503/227; 427/152; 428/32.39
(58) Field of Classification Search ..... None
See application file for complete search history.

(56) References Cited

U.S. PATENT DOCUMENTS

| | | | |
|---|---|---|---|
| 5,741,483 | A | 4/1998 | Okawa |
| 2002/0196321 | A1 | 12/2002 | Katsuki |

FOREIGN PATENT DOCUMENTS

| | | | |
|---|---|---|---|
| JP | 01-102551 | A | 4/1989 |
| JP | 04-012888 | A | 1/1992 |
| JP | 08-146556 | A | 6/1996 |
| JP | 2003-312145 | A | 11/2003 |
| JP | 2007-055254 | A | 3/2007 |
| JP | 2007-230048 | A | 9/2007 |
| WO | 2007/013649 | A | 2/2007 |

OTHER PUBLICATIONS

An Extended European Search Report dated Aug. 21, 2008.
Office Action dated Nov. 24, 2010 in Japanese Patent Application No. 2007-092502.

*Primary Examiner* — Bruce H Hess
(74) *Attorney, Agent, or Firm* — Sughrue Mion, PLLC

(57) ABSTRACT

A thermal transfer image-receiving sheet comprising a heat-insulating layer and an image-receiving layer on a support, wherein the receiving layer contains polymer latex, the heat-insulating layer contains hollow polymer, and at least two layers are formed by simultaneous multilayer coating, and wherein at least one layer on the side of the receiving layer on the support contains at least two compounds of the following formulae [I] to [IV]:

[I]

[II]

[III]

[IV]

wherein $R^1$, $R^2$, $R^{13}$-$R^{15}$, $R^{18}$, $R^{19}$ represent hydrogen etc.; $R^{20}$ represents lower alkylene; X represents hydrogen etc.; l is 2-6; m is 1-4; p is 0 or 1; and q is 0-5.

10 Claims, No Drawings

THERMAL TRANSFER IMAGE-RECEIVING SHEET AND SURFACE CONDITION IMPROVER

BACKGROUND OF THE INVENTION

1. Field of the Invention

The present invention relates to a thermal transfer image-receiving sheet and a surface condition improver, and precisely to a thermal transfer image-receiving sheet having high sensitivity and having few image defects and to a surface condition improver to be used in producing it.

2. Background Art

Heretofore, various thermal transfer recording methods are known; and above all, a dye diffusion transfer recording system is specifically noted as a process capable of producing color hard copies of which the image quality is the nearest to that of the images of silver salt photographs (for example, see "New Development of Information Recording (hard copy) and its Material", issued by Toray Research Center, 1993, pp. 241-285; and "Development of Printer Material", issued by CMC, 1995, p. 180). Moreover, as compared with silver salt photography, the system has various advantages in that it is a dry system, it enables direct visual image formation from digital data, it facilitates image duplication.

In the dye diffusion transfer recording system, a dye-containing thermal transfer sheet (hereinafter this may be referred to as "ink sheet") and a thermal transfer image-receiving sheet (hereinafter this may be referred to as "Image-receiving sheet") are put one upon another, then the ink sheet is heated with a thermal head from which the heat generation is controlled by an electric signal applied thereto, to thereby transfer the dye from the ink sheet to the image-receiving sheet for image information recording thereon. In the system, three colors of cyan, magenta and yellow may be transferred and recorded as overlaid, thereby giving a color image having a continuous color density gradation.

In the image-receiving sheet of this system, a receiving layer on which the transferred dye is fixed is formed on the support thereof, and in general, for increasing the adhesiveness between the image-receiving sheet and the transfer sheet, for example, a highly-cushionable layer such as a foam layer comprising a resin and a foaming agent or a porous layer containing a hollow polymer is formed between the support and the receiving layer (for example, see JP-A11-321128 and JP-A 2006-88691).

JP-A 11-321128 discloses a technique of forming, on a support, an interlayer comprising mainly hollow particles and an organic solvent-resistant polymer by coating and drying thereon, and then forming a receiving layer out of an organic solvent-based resin coating liquid applied thereto. In this, the organic solvent-resistant polymer for the interlayer plays a role of preventing the hollow particles in the interlayer from dissolving in the organic solvent in the receiving layer. However, the method of forming the receiving layer out of an organic solvent-based resin coating liquid has some problems in that the sensitivity is insufficient and the cost is high, and therefore, it is desired to improve the method in point of overcoming image defects (e.g., white spots) and increasing the transfer density.

On the other hand, a thermal transfer image-receiving sheet fabricated by water-base simultaneous multilayer coating is known (JP-A 2006-88691). This discloses a technique of simultaneous multilayer coating with a latex-containing coating liquid and a hollow particle-containing coating liquid thereby producing a thermal transfer sheet having high-density printing characteristics and excellent in printing uniformity. However, this has no description relating to incorporating a compound in the layer of the image-receiving sheet to thereby improve the properties of the sheet.

In addition, the simultaneous multilayer coating requires simultaneous coating with coating liquids containing a bulky solid substance in a high concentration, different from coating for conventional silver halide photographic materials, and therefore, it is technically difficult to attain coating surface uniformity of the thermal transfer image-receiving sheet obtained by simultaneous multilayer coating, and further improvements are desired.

On the other hand, JP-A 8-146556 and JP-A 10-234995 describe adding the compound for use in the invention to a support or inkjet image-receiving sheet as a preservative; but they are silent on adding it to the coating layer of a thermal transfer image-receiving sheet. In addition, JP-A 8-146556 and JP-A 10-234995 are silent on problems in surface modification and on a method for solving them.

SUMMARY OF THE INVENTION

For solving the problems in the prior art mentioned above, the present inventors have targeted a technique of providing a thermal transfer image-receiving sheet of high quality with no image density unevenness, as an object of the invention.

The present inventors have assiduously studied and, as a result, have found that, when compounds of the following formulae [I] to [IV] are added to a thermal transfer image-receiving sheet having a heat-insulating layer and an image-receiving layer formed on a support, in which the heat-insulating layer is formed of a water-base coating liquid that contains a hollow polymer but does not contain, apart from the hollow polymer, an aqueous dispersion of a resin not resistant to an organic solvent, and the receiving layer is formed of a polymer latex-containing water-base coating liquid, then the inventors may provide a thermal transfer image-receiving sheet of high quality with no image density unevenness at low costs. On the basis of these findings, the inventors have achieved the present invention.

Specifically, the above-mentioned objects can be attained by the following means:

(1) A thermal transfer image-receiving sheet comprising a heat-insulating layer and an image-receiving layer on a support, wherein the receiving layer contains at least one polymer latex, the heat-insulating layer contains at least one hollow polymer, and at least two layers are formed by simultaneous multilayer coating, and wherein at least one layer on the side of the receiving layer on the support contains at least two compounds of the following formulae [I] to [IV]:

[I]

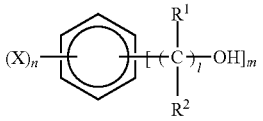

wherein $R^1$ and $R^2$ may be the same or different, each representing a hydrogen atom, a hydroxyl group, or a lower alkyl group; X represents a hydrogen atom, a halogen atom, a nitro group, a cyano group, an aryl group, A lower alkyl group, a lower alkenyl group, an aralkyl group, an alkoxy group, —$COR^3$, —$SO_2R^4$, or $N(R^5)R^6$; $R^3$ and $R^4$ may be the same or different, each representing a hydrogen atom, —OM, a lower alkyl group, a lower alkoxy group, or $N(R^7)R^8$;

$R^5$ and $R^6$ may be the same or different, each representing a hydrogen atom, a lower alkyl group, —$COR^9$, or $SO_2R^{10}$; $R^9$ and $R^{10}$ may be the same or different, each representing a lower alkyl group, or $N(R^{11})R^{12}$; $R^7$, $R^8$, $R^{11}$ and $R^{12}$ may be the same or different, each representing a hydrogen atom or a lower alkyl group;

M represents a hydrogen atom, an alkali metal atom, or an atomic group necessary for forming a monovalent cation; l indicates an integer of from 2 to 6; m indicates an integer of from 1 to 4; n is (6-m); and when the formula has plural $R^1$'s, $R^2$'s and X's, then they may be the same or different;

[II]

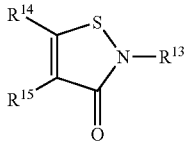

wherein $R^{13}$ represents a hydrogen atom, an alkyl group, an alkenyl group, an aralkyl group, an aryl group, a heterocyclic group,

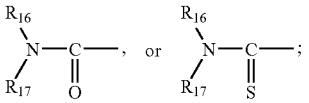

$R^{14}$ and $R^{15}$ may be the same or different, each representing a hydrogen atom, an alkyl group, an aryl group, a cyano group, a heterocyclic group, a halogen atom, a hydroxyl group, a sulfo group, an amino group, an alkylamino group, an acylamino group, an alkoxycarbonylamino group, an alkylthio group, an alkylsulfoxy group, or an alkylsulfonyl group; $R^{14}$ and $R^{15}$ may bond to each other to form an aromatic ring;

$R^{16}$ and $R^{17}$ may be the same or different, each representing a hydrogen atom, an alkyl group, an aryl group, or an aralkyl group;

[III]

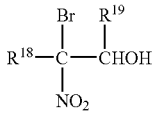

wherein $R^{18}$ represents a hydrogen atom, an alkyl group, or a hydroxymethyl group; $R^{19}$ represents a hydrogen atom, or an alkyl group;

[IV]

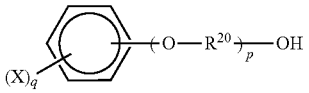

wherein $R^{20}$ represents a lower alkylene group; X represents a hydrogen atom, a halogen atom, a nitro group, a hydroxy group, a cyano group, a lower alkyl group, a lower alkoxy group, —$COR^{21}$, —$N(R^{22})R^{23}$, or —$SO_3M$; $R^{21}$ represents a hydrogen atom, —OM, a lower alkyl group, an aryl group, an aralkyl group, a lower alkoxy group, an aryloxy group, an aralkyloxy group, or —$N(R^{24})R^{25}$; $R^{22}$ and $R^{23}$ may be the same or different, each representing a hydrogen atom, a lower alkyl group, an aryl group, an aralkyl group, —$COR^{26}$, or —$SO_2R^{26}$; $R^{24}$ and $R^{25}$ may be the same or different, each representing a hydrogen atom, a lower alkyl group, an aryl group, or an aralkyl group; $R^{26}$ represents a lower alkyl group, an aryl group, or an aralkyl group; M represents a hydrogen atom, an alkali metal atom, or an atomic group necessary for forming a monovalent cation; p indicates 0 or 1; and q indicates an integer of from 0 to 5.

(2) The thermal transfer image-receiving sheet according to the above (1), wherein the compounds are in plural layers on the image-receiving layer side of the support.

(3) A surface condition improver containing at least two compounds of the above formulae [I] to [IV].

(4) The surface condition improver according to the above (3), which is for thermal transfer image-receiving sheets.

The thermal transfer image-receiving sheet of the invention provides a thermal transfer image of high quality with no image density unevenness. The surface modifier of the invention provides a thermal transfer image-receiving sheet having such characteristics.

BEST MODE FOR CARRYING OUT THE INVENTION

The thermal transfer image-receiving sheet of the invention is described in detail hereinunder. The description of the constitutive elements of the invention given hereinunder is for some typical embodiments of the invention, to which, however, the invention should not be limited. In this description, the numerical range expressed by the wording "a number to another number" means the range that falls between the former number indicating the lowermost limit of the range and the latter number indicating the uppermost limit thereof.

The thermal transfer image-receiving sheet of the invention comprises a heat-insulating layer and an image-receiving layer on a support, in which the receiving layer contains at least one polymer latex and the heat-insulating layer contains at least one hollow polymer, and at least two layers are formed by simultaneous multilayer coating, and which is characterized in that at least one layer on the side of the receiving layer on the support contains at least two compounds of the above formulae [I] to [IV]. At least three those compounds may be incorporated in the layer. However, when only one compound is added, it is ineffective for evading the problem of image density unevenness.

The compounds for use in the invention are described in detail.

In formula [I], $R^1$ and $R^2$ may be the same or different, each representing a hydrogen atom, a hydroxyl group, a lower alkyl group (e.g., methyl group, ethyl group, isopropyl group, tert-butyl group). X represents a hydrogen atom, a halogen atom (e.g., chlorine atom, bromine atom, fluorine atom), a nitro group, a cyano group, an aryl group (e.g., phenyl group, naphthyl group), a lower alkyl group (e.g., methyl group, ethyl group, n-butyl group, tert-octyl group), a lower alkenyl group (e.g. allyl group, propenyl group), an aralkyl group (e.g., benzyl group, phenethyl group), an alkoxy group (e.g., methoxy group, n-butoxy group, 2-methoxyethoxy group), —$COR^3$, —$SO_2R^4$, —$N(R^5)R^6$. $R^3$ and $R^4$ each represent a hydrogen atom, —OM, a lower alkyl group (e.g., methyl group, n-butyl group, tert-octyl group), a lower alkoxy group (e.g., methoxy group, ethoxy group, n-butoxy group), —$N(R^7)R^8$. $R^5$ and $R^6$ may be the same or different, each representing a hydrogen atom, a lower alkyl group (e.g., methyl group, ethyl group, 2-ethylhexyl group), —$COR^9$, —$SO_2R^{10}$. $R^9$ and $R^{10}$ each represent a lower alkyl group (e.g., methyl group, ethyl group, 2-methoxyethyl group), —N($R^{11}$)$R^{12}$. $R^7$, $R^8$, $R^{11}$ and $R^{12}$ may be the same or different, each representing a hydrogen atom, a lower alkyl group (e.g., methyl group, ethyl group, 2-ethylhexyl group). M represents a hydrogen atom, an alkali metal (e.g., sodium, potassium), or an atomic group necessary for forming a monovalent cation (e.g., ammonium cation, phosphonium cation); l indicates an integer of from 2 to 6; m indicates an integer of from 1 to 4; n indicates an integer of (6-m). When the formula has plural $R^1$, $R^2$, X, then they may be the same or different.

In formula [I], the number of the carbon atoms constituting the lower alkyl group and the lower alkoxy group for $R^1$, $R^2$ is preferably from 2 to B. Typical examples of the compounds of formula [I] are shown below, to which, however, the compounds of formula [I] for use in the invention should not be limited.

More preferably in formula [I], the number of the carbon atoms constituting the lower alkyl group and the lower alkoxy group for $R^1$, $R^2$ is preferably from 2 to 4, X is a hydrogen atom or a lower alkyl group, $R^1$ and $R^2$ each are a hydrogen atom or a lower alkyl group, m is an integer of 1 or 2, n is an integer of 4 or 5.

Typical examples of the compounds of formula [I] are shown below, to which, however, the compounds of formula [I] for use in the invention should not be limited. The following compounds are sold on the market as chemical reagents, and are easily available.

(I)-1

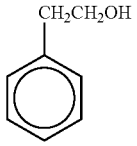

(I)-2

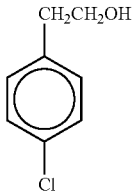

(I)-3

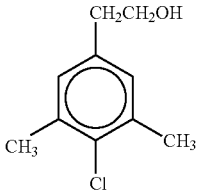

(I)-4

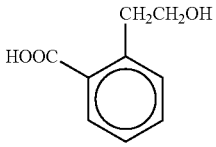

(I)-5

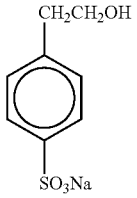

-continued (I)-6

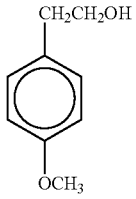

(I)-7

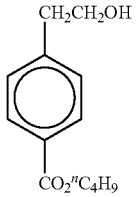

(I)-8

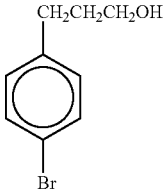

(I)-9

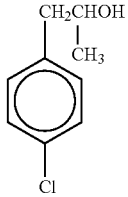

(I)-10

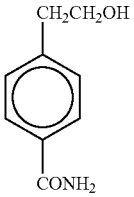

(I)-11

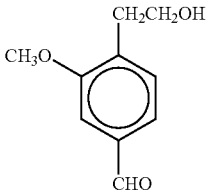

(I)-12

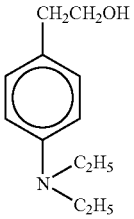

(I)-13

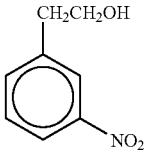

-continued (I)-14

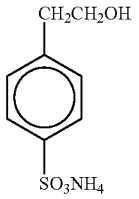

(I)-15

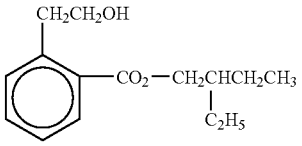

(I)-16

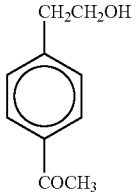

(I)-17

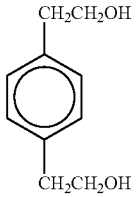

(I)-18

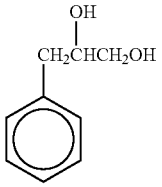

Compounds of formula [II] are described.

$R^{13}$ represents a hydrogen atom, a linear or branched, substituted or unsubstituted alkyl group (e.g., methyl group, ethyl group, tert-butyl group, n-octadecyl group, 2-hydroxyethyl group, 2-carboxyethyl group, 2-cyanoethyl group, sulfobutyl group, N,N-dimethylaminoethyl group), a substituted or unsubstituted cyclic alkyl group (e.g., cyclohexyl group, 3-methylcyclohexyl group, 2-oxocyclopentyl group), a substituted or unsubstituted alkenyl group (e.g., allyl group, methylallyl group), a substituted or unsubstituted aralkyl group (e.g., benzyl group, p-methoxybenzyl group, o-chlorobenzyl group, p-isopropylbenzyl group), a substituted or unsubstituted aryl group (e.g., phenyl group, naphthyl group, o-methylphenyl group, m-nitrophenyl group, 3,4-dichlorophenyl group), a heterocyclic group (e.g., 2-imidazolyl group, 2-furyl group, 2-thiazolyl group, 2-pyridyl group),

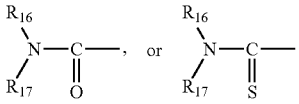

$R^{14}$ and $R^{15}$ each represent a hydrogen atom, a substituted or unsubstituted alkyl group (e.g., methyl group, ethyl group, chloromethyl group, 2-hydroxyethyl group, tert-butyl group, n-octyl group), a substituted or unsubstituted cyclic alkyl group (e.g., cyclohexyl group, 2-oxocyclopentyl group), a substituted or unsubstituted aryl group (e.g., phenyl group, 2-methylphenyl group, 3,4-dichlorophenyl group, naphthyl group, 4-nitrophenyl group, 4-aminophenyl group, 3-acetamidophenyl group), a cyano group, a heterocyclic group (e.g., 2-imidazolyl group, 2-thiazolyl group, 2-pyridyl group), a halogen atom (e.g. chlorine atom, bromine atom), a hydroxyl group, a sulfo group, an amino group, an alkylamino group (e.g. methylamino group, ethylamino group, dimethylamino group), an acylamino group (e.g. acetylamino group), an alkoxycarbonylamino group (e.g. methoxycarbonylamino group), a substituted or unsubstituted alkylthio group (e.g., methylthio group, 2-cyanoethylthio group, 2-ethoxycarbonylthio group), a substituted or unsubstituted arylthio group (e.g., phenylthio group, 2-carboxyphenylthio group, p-methoxyphenylthio group), a substituted or unsubstituted alkylsulfoxy group (e.g., methylsulfoxy group, 2-hydroxyethylsulfonyl group), a substituted or unsubstituted alkylsulfonyl group (e.g., methylsulfonyl group, 2-bromoethylsulfonyl group); $R^{14}$ and $R^{15}$ may bond to each other to form an aromatic ring (e.g., benzene ring, naphthalene ring).

$R^{16}$ and $R^{17}$ each represent a hydrogen atom, a substituted or unsubstituted alkyl group (e.g., methyl group, ethyl group, isopropyl group, 2-cyanoethyl group, 2-n-butoxycarbonylethyl group, 2-cyanoethyl group), a substituted or unsubstituted aryl group (e.g., phenyl group, naphthyl group, 2-methoxyphenyl group, m-nitrophenyl group, 3,5-dichlorophenyl group, 3-acetamidophenyl group), a substituted or unsubstituted aralkyl group (e.g. benzyl group, phenethyl group, p-isopropylbenzyl group, o-chlorobenzyl group, m-methoxybenzyl group).

Further preferably in formula [II], $R^{13}$ is a hydrogen atom or a lower alkyl group, and $R^{14}$ and $R^{15}$ bond to each other to form an aromatic ring.

Typical examples of the compounds of formula [II] are shown below, to which, however, the compounds of formula [II] for use in the invention should not be limited. Some of the following compounds are sold on the market and are readily available, or may be produced according to the production method described in French Patent 1,555,416.

Examples of Formula [II]

II-1

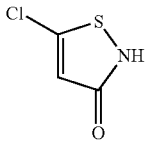

II-2

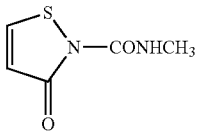

II-3

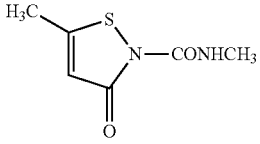

-continued
II-4
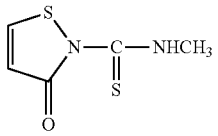
II-5
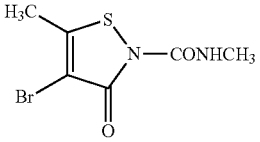
II-6
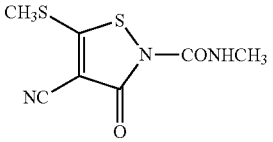
II-7
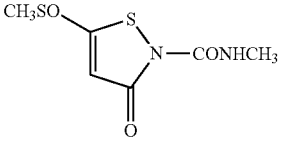
II-8
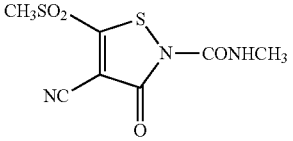
II-9
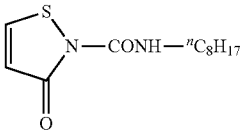
II-10
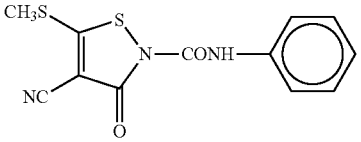
II-11
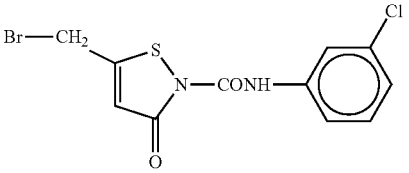
II-12
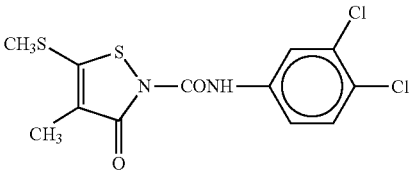
II-13
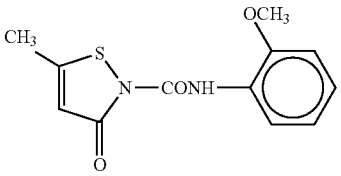
-continued
II-14
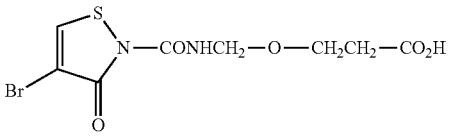
II-15
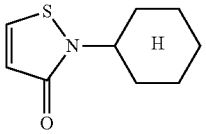
II-16
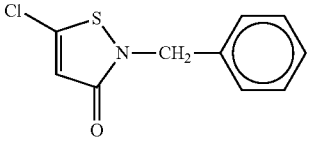
II-17
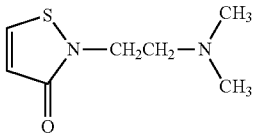
II-18
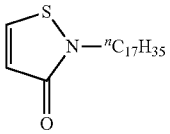
II-19
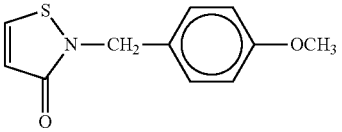
II-20
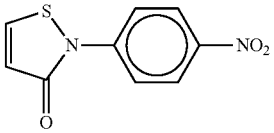
II-21
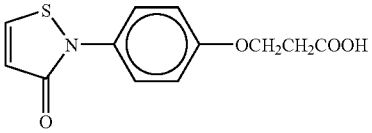
II-22
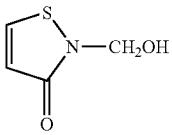
II-23
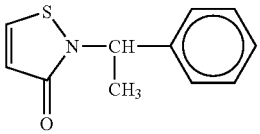

-continued
II-24
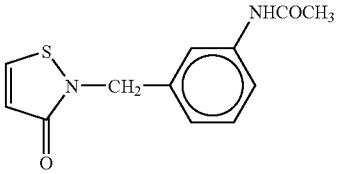
II-25
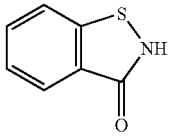
II-26
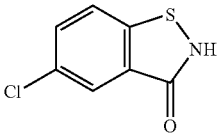
II-27
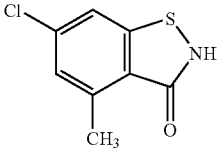
II-28
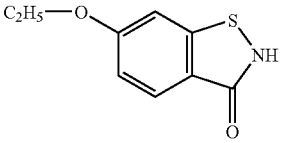
II-29
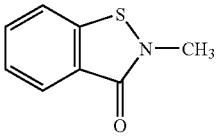
II-30
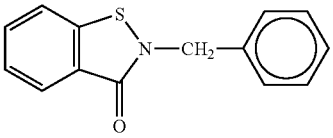
II-31
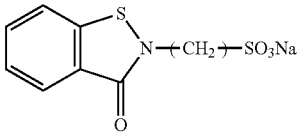
II-32
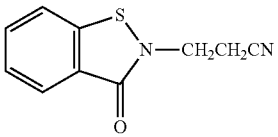
II-33
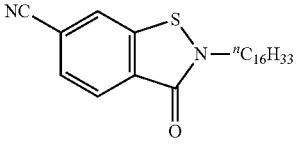
-continued
II-34
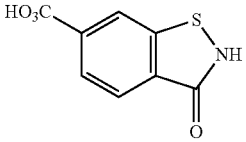
II-35
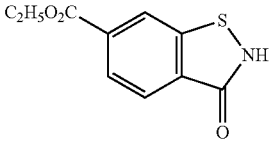
II-36
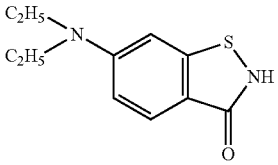
II-37
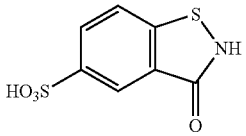
II-38
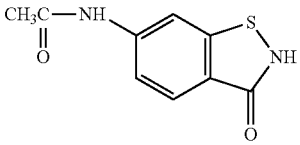
II-39
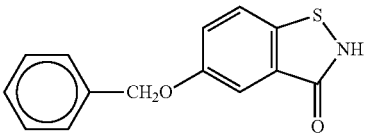
II-40
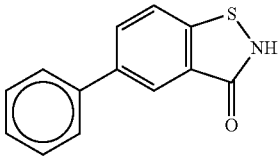
II-41
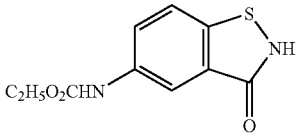
II-42
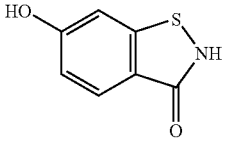
II-43
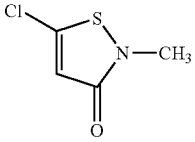

-continued

II-44

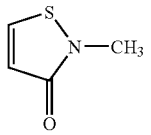

Compounds of formula [III] are described.

$R^{18}$ is represents a hydrogen atom, a lower alkyl group (e.g., methyl group, ethyl group, isopropyl group) or a hydroxymethyl group; $R^{19}$ represents a hydrogen atom or a lower alkyl group (e.g., methyl group, n-butyl group, isoamyl group). The lower alkyl group preferably has from 1 to 5 carbon atoms, more preferably 1 carbon atom.

Typical examples of the compounds of formula [III] are shown below, to which, however, the compounds of formula [III] for use in the invention should not be limited.

III-1

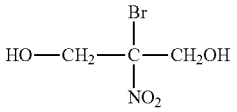

III-2

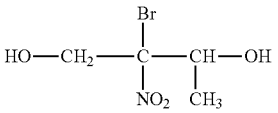

III-3

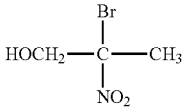

III-4

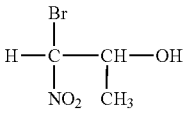

III-5

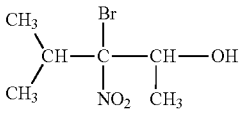

III-6

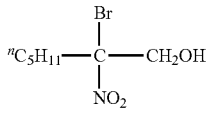

III-7

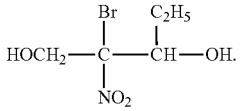

Some these compounds are commercially sold by San-ai Petroleum. The compounds may be produced with reference to the following literature.

(1) Henry Recuell des travaux chiniques des Rays-Bas, 16, 251.
(2) Mass. chemisches Zentralblatt. 1899 I 179.
(3) E. Schmidt. Berichte der Deutchen Chemischen Gesellschaft 397.
(4) E. Schmidt. ibid., 55 317.
(5) Henry Chemiches Zentrablatt. 1897 II 388.

Preferably, (III-1) is produced according to the literature (1), (2) or (3); (III-2) is according to (2); (III-3) is according to (5); and (111-4) is according to (2).

Compounds of formula [IV] are described.

In formula [IV], $R^{20}$ represents a lower alkylene group (e.g., ethylene group, propylene group, methylethylene group), preferably an alkylene group having from 1 to 6 carbon atoms.

X represents a halogen atom (e.g., chlorine atom, bromine atom, fluorine atom), a nitro group, a hydroxyl group, a cyano group, a lower alkyl group (e.g., methyl group, ethyl group, isopropyl group, tert-butyl group), —$COR^{21}$, —$N(R^{22})R^{23}$ or —$SO_3M$; $R^{21}$ represents a hydrogen atom, —OM, a lower alkyl group (e.g. methyl group, n-butyl group, tert-octyl group), an aryl group (e.g., phenyl group, 4-chlorophenyl group, 3-nitrophenyl group), an aralkyl group (e.g., benzyl group, p-isopropylbenzyl group, o-methylbenzyl group), a lower alkoxy group (e.g., methoxy group, n-butoxy group, 2-methoxyethoxy group), an aryloxy group (e.g., phenoxy group, naphthoxy group, 4-nitrophenoxy group), an aralkyloxy group (e.g., benzyloxy group, p-chlorobenzyloxy group), or —$N(R^{24})R^{25}$.

$R^{22}$ and $R^{23}$ each represent a hydrogen atom, a lower alkyl group (e.g., methyl group, ethyl group, 2-ethylhexyl group), an aryl group (e.g., phenyl group, naphthyl group, 2-methoxyphenyl group, 3-acetamidophenyl group), an aralkyl group (e.g., benzyl group, o-chlorobenzyl group), —$COR^{26}$ or —$SO_2R^{26}$, and they may be the same or different. $R^{24}$ and $R^{25}$ each represent a hydrogen atom, a lower alkyl group (e.g., methyl group, isopropyl group, 2-cyanoethyl group), an aryl group (e.g., phenyl group, 4-ethoxycarbonylphenyl group, 3-nitrophenyl group), an aralkyl group (e.g., benzyl group, p-chlorobenzyl group), and they may be the same or different. $R^{26}$ represents a lower alkyl group (e.g., ethyl group, 2-methoxyethyl group, 2-hydroxyethyl group) or an aryl group (e.g., phenyl group, naphthyl group, 4-sulfophenyl group, 4-carboxyphenyl group); M represents a hydrogen atom, an alkali metal atom (e.g., sodium, potassium), or an atomic group necessary for forming a monovalent cation (e.g., ammonium cation, phosphonium cation); p indicates 0 or 1; q indicates 0 or an integer of from 1 to 5.

Preferably, the lower alkyl group and the lower alkoxy group in formula [IV] have from 1 to 8 carbon atoms each. More preferred are the compound where $R^{20}$ is an alkyl group having from 1 to 3 carbon atoms; X is a lower alkyl group; p is 1; q is 0 or 1. Typical examples of the compounds of formula [IV] are shown below, to which, however, the compounds of formula [IV] for use in the intention should not be limited. Most of the following compounds are sold on the market as chemical reagents and are readily available, or may be readily produced according to already existing production methods. For example, some compounds where m=1 are readily produced according to the method described in J. Am. Chem. Soc., Vol. 41, p. 669, 1919.

Examples of Formula [IV]

IV-1

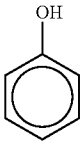

-continued
IV-2
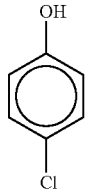
IV-3
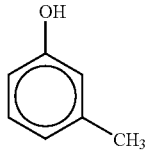
IV-4
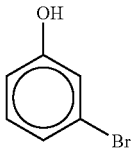
IV-5
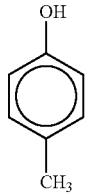
IV-6
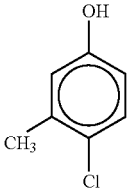
IV-7
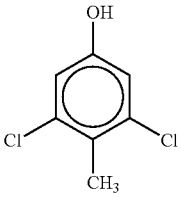
IV-8
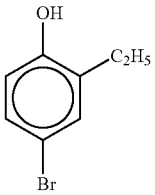
IV-9
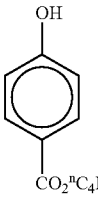
-continued
IV-10
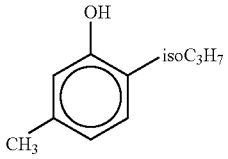
IV-11
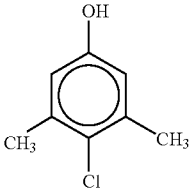
IV-12
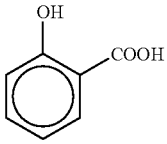
IV-13
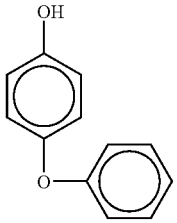
IV-14
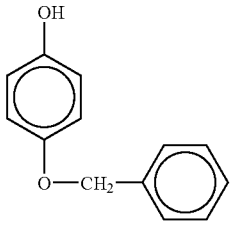
IV-15
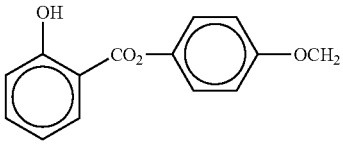
IV-16
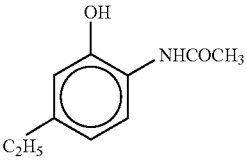
IV-17
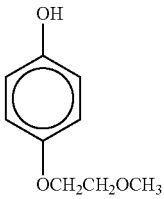

-continued
IV-18
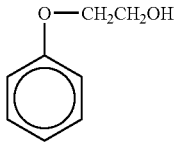
IV-19
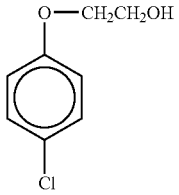
IV-20
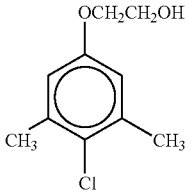
IV-21
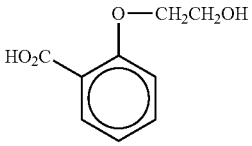
IV-22
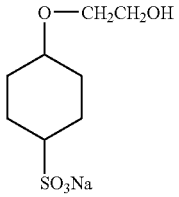
IV-23
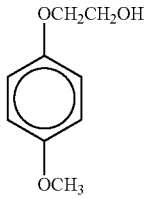
IV-24
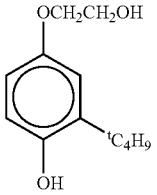
IV-25
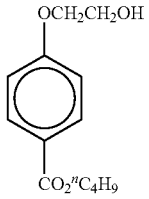
-continued
IV-26
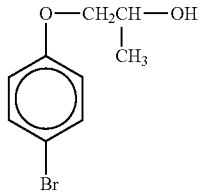
IV-27
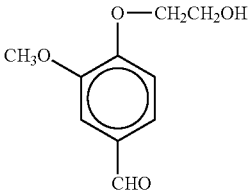
IV-28
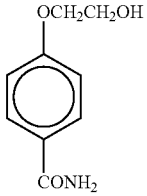
IV-29
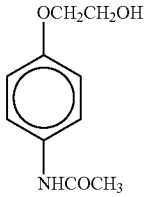
IV-30
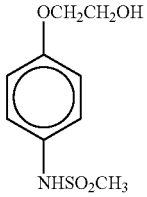
IV-31
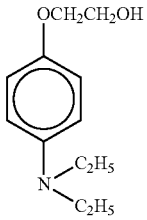
IV-32
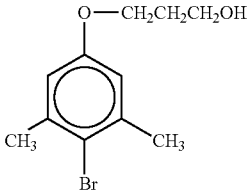

-continued

IV-33

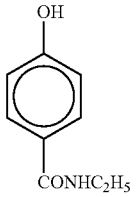

IV-34

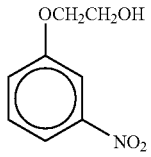

IV-35

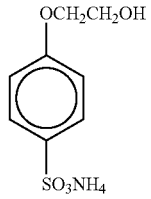

IV-36

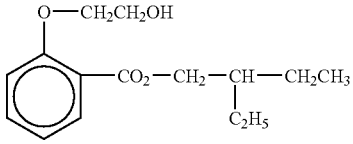

IV-37

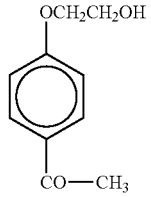

IV-38

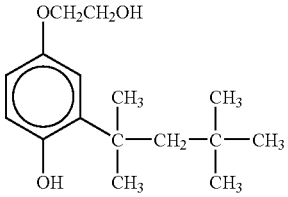

The thermal transfer image-receiving sheet of the invention has at least one dye-receiving layer (receiving layer) on a support, and has at least one heat-insulating layer (porous layer between the support and the receiving layer. In addition, for example, underlayers such as white background-controlling layer, static charge-controlling layer, adhesive layer and primer layer may be formed between the receiving layer and the heat-insulating layer.

At least two layers constituting the thermal transfer image-receiving sheet of the invention are formed by simultaneous multilayer coating. In particular, it is desirable that the receiving layer and the heat-insulating layer are formed by simultaneous multilayer coating. In case where the sheet has an underlayer, the receiving layer, the underlayer and the heat-insulating layer may be formed simultaneous multilayer coating.

Preferably, a curl-controlling layer, a writing layer and a static charge-controlling layer are formed on the back of the support. The layers may be formed on the back of the support by any ordinary method of roll coating, bar coating, gravure coating, gravure reverse coating.

(Receiving Layer)

The receiving layer plays a role of receiving the dye transferred from an ink sheet and holding the formed image. In the thermal transfer image-receiving sheet of the invention, the receiving layer contains a polymer latex. The receiving layer may be one layer or two or more layers. Preferably, the receiving layer contains a water-soluble polymer mentioned below.

<Polymer Latex>

The polymer latex is described. In a thermal transfer image-receiving sheet, the polymer latex to be in the receiving layer is a dispersion of water-insoluble hydrophobic polymer particles dispersed in a water-soluble dispersion medium. The dispersion may be any one prepared by emulsifying a polymer in a dispersion medium, one prepared by emulsification and polymerization, one prepared by micelle dispersion, or a molecular dispersion of polymer molecules partially having a hydrophilic structure, in which the molecular chains themselves are molecularly dispersed. The polymer latex is described, for example, in Taira Okuda & Hiroshi Inagak, "Synthetic Resin Emulsion", issued by the Polymer Publishing, 1978; Takaeaki Sugimura, Yasuo Rataoka, Soichi Suzuki, & Keiji Kasahara, "Applications of Synthetic Latex", issued by the Polymer Publishing, 1993; Soichi Muroi, "Chemistry of Synthetic Latex", issued by the Polymer Publishing, 1970; Yoshiaki Miyosawa, "Development and Application of Water-Base Coating Material", by CMC, 2004; and JP-A 64-528. The mean particle size of the dispersion particles is preferably within a range of from 1 to 50000 nm, more preferably from 5 to 1000 nm. The particle size distribution of the dispersion particles is not specifically defined, and the particles may have a broad particle size distribution or may have a monodispersion particle size distribution.

The polymer latex may be an ordinary uniform-structured polymer latex, and in addition, it may also be a core/shell-structured polymer latex. In the latter case, it is often desirable that the core and the shell have a different glass transition temperature. The glass transition temperature of the polymer latex for use in the invention is preferably from −30° C. to 100° C., more preferably from 0° C. to 80° C., still more preferably 10° C. to 70° C., particularly preferably 15° C. to 60° C.

As preferred embodiments of the polymer latex, hydrophobic polymers are preferably used therein, including, for example, acrylic polymers, polyesters, rubbers (e.g., SBR resin), polyurethanes, polyvinyl chlorides, polyvinyl acetates, polyvinylidene chlorides, polyolefins. These polymers may be linear polymers, or branched polymers, or crosslinked polymers, and they may be homopolymers formed by polymerization of a single monomer or copolymers formed by copolymerization of two or more different monomers. The copolymers may be random copolymers or block copolymers. Preferably, the number-average molecular weight of the polymer is from 5000 to 1000000, more preferably from 10000 to 500000. In case where a polymer having a too small molecular weight is used, the mechanical strength of the layer containing the polymer latex may be insufficient; but when a polymer having a too large molecular weight is used, then it is unfavorable since its film formability is poor. A crosslinked polymer latex is also preferably used in the invention.

Polymer latex is commercially available, and the following polymers are usable. Examples of acrylic polymers are Daicel Chemical Industry's Sevian A-4635, 4718, 4601; Nippon Zeon's Nipol Lx811, 814, 821, 820, 855 (P-17: Tg 36° C.), 857×2 (P-18: Tg 43° C.); Dai-Nippon Ink Chemical's Voncoat R3370 (P-19; Tg 25° C.), 4280 (P-20: Tg 15° C.), Nippon Pure Chemicals' Jurymer ET-410 (P-21: Tg 44° C.), JSR's AE116 (P-22: Tg 50° C.), AE119 (P-23: Tg 55° C.), AE121 (2-24: Tg 58° C.), AE125 (P-25: Tg 60° C.), AE134 (P-26: Tg 48° C.), AE137 (P-27: Tg 48° C.), AE140 (P-28: Tg 53° C.), AE173 (P-29: Tg 60° C.), Toa Gosei's Aron A-104 (P-30: Tg 45° C.), Takamatsu Yushi's NS-600X, NS-620X, Nisshin Chemical Industry's Vinybran 2580, 2583, 2641, 2770, 2770H, 2635, 2886, 5202C, 2706 (all trade names).

Examples of polyesters are Dai-Nippon Ink Chemical's FINETEX ES650, 611, 675, 850, Eastman Chemical's WD-size, WMS, Takamatsu Yushi's A-110, A-115GE, A-120, A-121, A-124GP, A-124S, A-160P, A-210, A-215GE, A-510, A-513E, A-515GE, A-520, A-610, A-613, A-615GE, A-620, WAC-10, WAC-15, WAC-17XC, WAC-20, S-110, S-110EA, S-111SL, S-120, S-140, S-140A, S-250, S-252G, S-250S, S-320, S-680, DNS-63P, NS-122L, NS-122LX, NS-244LX, NS-140L, NS-141LX, NS-282LX, Toa Gosei's Aron Melt PES-1000 Series, PES-2000 Series, Toyobo's Vylonal MD-1100, MD-1200, MD-1220, MD-1245, MD-1250, MD-1335, MD-1400, MD-1480, MD-1500, MD-1930, MD-1985, Sumitomo Seika's Ceporjon ES (all trade names).

Examples of polyurethanes are Dai-Nippon Ink Chemical's HYDRAN AP10, AP20, AP30, AP40, 101H, Vondic 1320NS, 1610NS, Dainichi Seika's D-1000, D-2000, D-6000, D-4000, D-9000, Takamatsu Yushi's NS-155X, NS-310A, NS-310X, NS-311X, Dat-ichi Kogyo Pharmaceutical's Elastron (all trade names).

Examples of rubbers are LACSTAR 7310K, 3307B, 4700H, 7132C (all by Dai-Nippon Ink Chemical), Nipol Lx416 LX410, LX430, LX435, LX110, LX415A, LX438C, 2507H, LX303A, LX407BP Series, V1004, MH5055 (all by Nippon Zeon) (all trade names).

Examples of polyvinyl chlorides are Nippon Zeon's G351, G576, Nisshin Chemical Industry's Vinybran 240, 270, 277, 375, 386, 609, 550, 601, 602, 630, 660, 671, 683, 680, 680S, 681N, 685R, 277, 380, 381, 410, 430, 432, 860, 863, 865, 867, 900, 900GT, 938, 950 (all trade names). Examples of polyvinylidene chlorides are Asahi Kasei's L502, L513, Dai-Nippon Ink Chemicals D-5071 (all trade names). Examples of polyolefins are Mitsui Petrochemical's Chemipearl S120, SA100, V300 (P-40: Tg 80° C.), Dai-Nippon Ink Chemical's Voncoat 2830, 2210, 2960, Sumitomo Seika's Zaikthene, Ceporjon G; and examples of copolymer nylons are Sumitomo Seika's Ceporjon PR (all trade names).

Examples of polyvinyl acetates are Nisshin Chemical Industry's Vinybran 1080, 1082, 1035W, 1108W, 1108S, 1563M, 1566, 1570, 1588C, A22J7-F2, 1128C, 1137, 1138, A20J2, A23J1, A23K1, A23P2E, A68J1N, 1086A, 1086, 1086D, 1108S, 1187, 1241LT, 1580N, 1083, 1571, 1572, 1581, 4465, 4466, 4463W, 4468S, 4470, 4485LL, 4495LL, 1023, 1042, 1060, 1060S, 1080M, 1084W, 1084S, 1096, 1570K, 1050, 1050S, 3290, 1017AD, 1002, 1100, 1003, 1107L, 1225, 1245L, GV-6170, GV-6181, 4468W, 4468S (all trade names).

One or more these polymer latexes may be used herein either singly or as combined.

Preferably in the invention, the receiving layer is formed by applying a water-base coating liquid onto a support and drying it thereon. "Water-base" as referred to herein means that at least 60% by mass of the solvent (dispersion medium) of the coating liquid is water. As the other component than water in the coating liquid, usable is a water-miscible organic solvent such as methyl alcohol, ethyl alcohol, isopropyl alcohol, methyl cellosolve, ethyl cellosolve, dimethylformamide, ethyl acetate, diacetonalcohol, furfuryl alcohol, benzyl alcohol, diethylene glycol monomethyl ether, oxyethyl phenyl ether.

The lowermost film-forming temperature (melt flow temperature, MFT) of the polymer latex is preferably from −30° C. to 90° C., more preferably from 0° C. to 70° C. or so. For controlling the lowermost film-forming temperature, a filming promoter may be added to the polymer latex. The filming promoter may be referred to as a temporary plasticizer, and this is an organic compound (in general, an organic solvent) that lowers the lowermost film-forming temperature of the polymer latex, and is described, for example, in Soichi Muroi, "Chemistry of Synthetic Latex", issued by the Polymer Publishing, 1970. The compounds mentioned below are preferred for the filming promoter; however, the compounds usable in the invention should not be limited to these examples.

Z-1: benzyl alcohol

Z-2: 2,2,4-trimethylpentanediol 1,3-monoisobutyrate

Z-3: 2-dimethylaminoethanol

Z-4: diethylene glycol

Preferred examples of the polymer latex for use in the invention are polylactates, polyurethanes, polycarbonates, polyesters, polyacetals, SBRs, polyvinyl chlorides. Of those, most preferred are polyesters, polycarbonates, polyvinyl chlorides.

The polymer latex for use in the invention may contain any other polymer along with the polymer latex. The polymer that may be combined with it is preferably transparent or semi-transparent and colorless, including natural resins, polymers and copolymers, and synthetic resins, polymers and copolymers, and other film-forming media, for example, gelatins, polyvinyl alcohols, hydroxyethyl celluloses, cellulose acetates, cellulose acetate butyrates, polyvinylpyrrolidones, casein, starch, polyacrylic acids, polymethyl methacrylates, polyvinyl chlorides, polymethacrylic acids, styrene-maleic anhydride copolymers, styrene-acrylonitrile copolymers, styrene-butadiene copolymers, polyvinyl acetals (e.g., polyvinyl formal, polyvinyl butyral), polyesters, polyurethanes, phenoxy resins, polyvinylidene chlorides, polyepoxides, polycarbonates, polyvinyl acetates, polyolefins, polyamides. The binder may be formed from water or from an organic solvent or an emulsion by coating.

The binder for use in the invention preferably has a glass transition temperature (Tg) falling within a range of from −30° C. to 70° C. from the working brittleness and the image storability, more preferably from −10° C. to 50° C., even more preferably from 0° C. to 40° C. Two or more polymers may be blended for the binder. In this case, it is desirable that the weighted mean Tg of the polymer blend formed in consideration of the composition thereof falls within the above range. In case where the blend has phase separation or a core/shell structures it is also desirable that the weighted mean Tg thereof falls within the above range.

The polymer to be used for the hinder for use in the invention may be readily obtained through solution polymerization, suspension polymerization, emulsion polymerization, dispersion polymerization, anionic polymerization, cationic polymerization, etc. Most preferred is emulsion polymerization capable of giving the polymer as a latex. Also preferred is a method of preparing a polymer in a solution, then adding water thereto after neutralization or after adding an emulsifier thereto, and forcedly stirring it to prepare an aqueous dispersion. The emulsion polymerization method may be attained, for example, as follows: Water, or a mixed solvent of water and a water-miscible organic solvent (e.g., methanol, ethanol, acetone) is used as a dispersion medium, and a monomer mixture in an amount of from 5 to 150% by mass relative to the dispersion medium and an emulsifier and a polymerization relative to the total monomer amount are used, and the system is polymerized with stirring at 30 to 100° C. or so, preferably at 60 to 90° C. for 3 to 24 hours. The conditions of the dispersion medium, the monomer concentration, the amount of initiator, the amount of emulsifier, the amount of dispersant, the reaction temperature and the mode of monomer addition may be suitably determined in consideration of the type of the monomer to be used. If desired, a dispersant is preferably used.

For the polymer latex for use in the invention, a water-base solvent may be used as the solvent for the coating liquid, but the solvent may be combined with a water-miscible organic solvent. The water-miscible organic solvent includes, for example, alcohols such as methyl alcohol, ethyl alcohol; cellosolves such as methyl cellosolve, ethyl cellosolve, butyl cellosolve; ethyl acetate, dimethylformamide. The amount of the organic solvent to be added is preferably at most 50% by mass of the solvent, more preferably at most 30% by mass.

Preferably, the polymer latex for use in the invention has a polymer concentration of from 10 to 70% by mass of the latex, more preferably from 20 to 60% by mass, even more preferably from 30 to 55% by mass.

The polymer latex in the thermal transfer image-receiving sheet of the invention includes a gel or a dry film formed by partly removing the solvent by drying after coating.

<Water-Soluble Polymer>

The receiving layer preferably contains a water-soluble polymer. The water-soluble polymer fur use in the invention includes natural polymers (from polysaccharides, microorganisms, animals), semisynthetic polymers (from cellulose, starch, alginic acid), and synthetic polymers (vinyl-type, others). Synthetic polymers such as polyvinyl alcohol to be mentioned below, as well as natural or semisynthetic polymers starting from vegetable-derived cellulose or the like correspond to the water-soluble polymer for use in the invention. The water-soluble polymer in the invention does not include the above-mentioned polymer latex.

In order to differentiate the water-soluble polymer from the above-mentioned polymer latex, the water-soluble polymer may be referred to as binder in the invention.

Of the water-soluble polymers usable in the invention, natural polymers and semisynthetic polymers are described in detail. The vegetable-derived polysaccharides include gum arabic, κ-carrageenan, ι-carrageenan, λ-carrageenan, guar gum (e.g., Squalon's Supercol), locust bean bum, pectin, tragacanth, corn starch (e.g., National Starch & Chemical's Purity-21), phosphorylated starch (e.g., National Starch & Chemical's National 78-1898); the microorganism-derived polysaccharides include xanthan gum (e.g., Kelco's Keltrol T), dextrin (e.g. National Starch & Chemical's Nadex360); the animal-derived natural polymers include gelatin (e.g., Croda's Crodyne B419), casein, sodium chondroitin sulfate (e.g., Croda's Cromoist CS) (all trade names). The cellulose-derived polymers include ethyl cellulose (e.g., I.C.I.'s Cellofas WLD), carboxymethyl cellulose (e.g., Daicel's CMC), hydroxyethyl cellulose (e.g., Daicel's HEC), hydroxypropyl cellulose (e.g., Aqualon's Klucel), methyl cellulose (e.g., Henkel's Viscontran), nitrocellulose (e.g., Hercules's Isopropyl Wet), cationated cellulose (e.g., Croda's Crodacel QM) (all trade names). The starch-derived polymers include phosphorylated starch (e.g., National Starch & Chemical's National 78-1898); the alginic acid-derived polymers include sodium alginate (e.g., Kelco's Keltone), propylene glycol alginate; and as other groups, usable are cationated guar gum (e.g., Alcolac's Hi-care1000), sodium hyaluronate (e.g., Lifecare Biomedial's Hyalure) (all trade names).

Of the water-soluble polymers for use in the invention, synthetic polymers are described in detail. The acrylic polymers include sodium polyacrylate, polyacrylic acid copolymer, polyacrylamide, polyacrylamide copolymer, polydiethylaminoethyl (meth)acrylate quaternary salt or its copolymer; the vinyl polymers include polyvinylpyrrolidone, polyvinylpyrrolidone copolymer, polyvinyl alcohol; and other polymers include polyethylene glycol, polypropylene glycol, polyisopropylacrylamide, polymethyl vinyl ether, polyethyleneimine, polystyrenesulfonic acid or its copolymer, naphthalenesulfonic acid condensate salt, polyvinylsulfonic acid or its copolymer, polyacrylic acid or its copolymer, acrylic acid or its copolymer, as well as maleic acid copolymer, monomaleate copolymer, acryloylmethylpropanesulfonic acid or its copolymer, polydimethyldiallylanmonium chloride or its copolymer, polyamidine or its copolymer, polyimidazoline, dicyandiamide condensate, epichlorohydrin/dimethylamine condensate, Hoffman-decomposed polyacrylamide, water-soluble polyester (Goo Chemical's Plas Coat Z-221, Z-446, Z-561, Z-450, Z-565, Z-850, Z-3308, RZ-105, RZ-570, Z-730, RZ-142) (all trade names).

In addition, as described in U.S. Pat. No. 4,960,681 and JP-A 62-245260, high-absorbent polymers, or that is, homopolymers of a vinyl monomer having —COOM or —$SO_3M$ (M is a hydrogen atom or an alkali metal) or copolymers of the vinyl monomers or copolymers of the vinyl monomer with any other vinyl monomer (for example, sodium methacrylate, ammonium methacrylate, Sumitomo Chemical's Sumikagel L-5H (trade name) as the vinyl monomer) are also usable herein.

Of the water-soluble synthetic polymers usable in the invention, preferred are various polyvinyl alcohols such as completely saponified ones, partially saponified ones and modified polyvinyl alcohols, as in Koichi Nagano et al's "Poval" issued by the Polymer Publishing. Modified polyvinyl alcohols include those modified with cation, anion, —SH compound, alkylthio compound or silanol.

Depending on minor solvents or inorganic salts to be added to its aqueous solution, polyvinyl alcohol makes it possible to control or stabilize its viscosity; and precisely, those described in the above-mentioned reference, Koichi Nagano et al's "Poval" A issued by the Polymer Publishing, pp. 144-154 can be used. As one typical example, boric acid is preferably added to the polymer so as to improve the coating surface quality. The amount of boric acid to be added is preferably from 0.01 to 40% by mass relative to polyvinyl alcohol.

Preferably, the binder is transparent or semitransparent, and is generally colorless. The binder is a water-soluble binder, including natural resins, polymers and copolymers, and synthetic resins, polymers and copolymers, and other film-forming media, for example, rubbers, polyvinyl alcohols, hydroxyethyl celluloses, cellulose acetates, cellulose acetate butyrates, polyvinylpyrrolidones, starch, polyacrylic acids, polymethyl methacrylates, polyvinyl chlorides, polymethacrylic acids, styrene-maleic anhydride copolymers, styrene-acrylonitrile copolymers, styrene-butadiene copolymers, polyvinyl acetals (e.g., polyvinyl formal, polyvinyl butyral), polyesters, polyurethanes, phenoxy resins, polyvinylidene chlorides, polyepoxides, polycarbonates, polyvinyl acetates, polyolefins, cellulose esters, polyamides.

In the invention, the water-soluble polymer is preferably polyvinyl alcohols, gelatin, most preferably gelatin.

The amount of the water-soluble polymer in the receiving layer is preferably from 1 to 25% by mass of all the receiving layer, more preferably from 1 to 10% by mass.

The content of the compounds of formulae [I] to [IV] is preferably from 1 to 100000 ppm relative to the water-soluble polymer. More preferably, relative to the content of the water-soluble polymer, the content of the compounds of formulae [I] and [IV] is from 500 to 100000 ppm, that of the compound of formula [II] is from 50 to 10000 ppm, and that of the compound of formula [III] is from 1 to 1000 ppm. In case where thermal transfer image-receiving sheet has plural layers, it is desirable that the compounds of formulae [I] to [IV], especially the compounds of formulae [II] to [IV] are added to plural layers, more preferably to the receiving layer and the heat-insulating layer. In case where the compounds are incorporated in only one layer, it is desirable that they are incorporated in A layer containing a water-soluble polymer.

<Crosslinking Agents>

The above-mentioned water-soluble polymer in the receiving layer may be partly or wholly crosslinked with a crosslinking agent.

The crosslinking agent may have plural groups capable of reacting with an amino group, a carboxyl group or a hydroxyl group in the molecule, and suitably selected depending on the type of the water-soluble polymer, and the type of the crosslinking agent is not specifically defined. The methods described in T. H. James, "THE THEORY OF THE PHOTOGRAPHIC PROCESS FOURTH EDITION" (Macmillan Publishing Co. Inc., 1977), pp. 77-87, and the crosslinking agents described in U.S. Pat. No. 4,678,739, column 41, JP-A 59-116655, 62-245261, 61-18942 are suitable for use herein. Any of crosslinking agents of inorganic compounds (e.g., chromium alum, boric acid and its salts) and crosslinking agents of organic compounds are preferred. In addition, also usable is a crosslinking agent that comprises a mixed aqueous solution containing a chelating agent and a zirconium compound and having pH of from 1 to 7, as in JP-A 2003-231775.

<UV Absorbent>

The receiving layer may contain a UV absorbent for improving the light fastness thereof. In this, when a polymer UV absorbent is used, it may be fixed to the receiving layer, and may be prevented from diffusing into ink sheet and from subliming and evaporating under heat.

As the UV absorbent, usable are various UV absorbent skeleton-having compounds widely well known in the field of information recording. Concretely, there are mentioned compounds having a skeleton of 2-hydroxybenzotriazole-type UV absorbents, 2-hydroxybenzotriazine-type UV absorbents or 2-hydroxybenzophenone-type UV absorbents. From the viewpoint of the UV absorption capability (absorbent coefficient) and the stability, preferred are compounds having a benzotriazole or triazine skeleton; and from the viewpoint of forming them into polymer or latex, preferred are compounds having a benzotriazole or benzophenone skeleton. Concretely, the UV absorbents described in JP-A 2004-361936 may be used herein.

Preferably, the UV absorbent has an absorption in the UV range and its absorption edges do not step in the visible range. Concretely, when a UV absorbent is added to a receiving layer in producing a thermal transfer image-receiving sheet, it is desirable that the reflection density at 370 nm is Abs 0.5 or more; more preferably the reflection density at 380 nm is Abs 0.5 or more. Also preferably, the reflection density at 400 nm is Abs 0.1 or less. In case where the reflection density within a range over 400 nm is high, it is undesirable since the formed image may yellow.

<Lubricant>

The receiving layer may contain a lubricant for preventing thermal fusion with a thermal transfer sheet in image formation. For the lubricant, usable are silicone oil, phosphate plasticizers, fluorine compounds. Especially preferred is silicone oil. As the silicone oil, preferably used is a modified silicone oil, such as epoxy-modified, alkyl-modified, amino-modified, carboxyl-modified, alcohol-modified, fluorine-modified, alkylaralkyl-polyether-modified, epoxy-polyether-modified or polyether-modified one. Above all, preferred is a reaction product of a vinyl-modified silicone oil and a hydrogen-modified silicone oil. The amount of the lubricant to be added is preferably from 0.2 to 30 parts by mass relative to the receiving polymer.

The coating amount of the receiving layer is preferably from 0.5 to 10 g/m$^2$ (in terms the solid content of the layer —unless otherwise specifically indicated in this description, the coating amount is in terms of the solid content of the layer). Preferably, the thickness of the receiving layer is from 1 to 20 μm.

(Heat-Insulating Layer)

The heat-insulating layer plays a role of protecting the support from heat in thermal transfer with thermal head. In addition, since the layer is highly cushionable, the thermal transfer image-receiving sheet having the layer may have high printing sensitivity even when its support is formed of paper. The heat-insulating layer may be one layer or two layers. The heat-insulating layer may be provided nearer to the support than the image-receiving layer.

In the thermal transfer image-receiving sheet of the invention, the heat-insulating layer comprises a hollow polymer.

The hollow polymer as referred to in the invention is polymer particles having closed pores inside the particles, including, for example, (1) non-foamed hollow particles of polystyrene, acrylic resin, styrene-acrylic resin or the like, in which water exists inside the area surrounded by partition walls, and which are such that, after applied onto a support and dried thereon, the water inside the particles evaporates and the particles therefore become hollow, (2) foamed microballoons produced by coating a low-boiling point liquid such as butane, pentane or the like with a resin of any of polyvinylidene chloride, polyacrylonitrile, polyacrylic acid, polyacrylate or their mixture or polymer, which are such that, after applied onto a support and heated thereon, the low-boiling-point liquid inside the particles expands to make the particles hollow, and (3) microballoons produced by previously overheating and foaming the above (2) to give a hollow polymer.

Preferably, the hollow polymer has a porosity of from 20 to 70% or so; and if desired, two or more different types of such hollow polymers may be combined and used herein. Concrete examples of the above (1) are Rohm & Haas' Lowpake 1055, Dai-Nippon Ink's Boncoat PP-1000, JSR's SX866(B), Nippon Zeon's Nippol MH5055 (all trade names). Examples of the above (2) are Matsumoto Yushi Seiyaku's F-30, F-50 (both trade names). Examples of (3) are Matsumoto Yushi Seiyaku's F-30E, Nippon Ferrite's Expancel 461DE, 551DE, 551DE20 (all trade names). The hollow polymer used in the heat-insulating layer may be latex.

The interlayer containing the hollow polymer preferably contains a water-dispersible resin or a water-soluble resin as a binder resin. The binder resin for use in the invention may be any known resin including acrylic resin, styrene-acryl copolymer, polystyrene resin, polyvinyl alcohol resin, vinyl acetate resin, ethylene-vinyl acetate copolymer, vinyl chloride-vinyl acetate copolymer, styrene-butadiene copolymer, polyvinylidene chloride resin, cellulose derivative, casein, starch, gelatin. These resins may be used either singly or as combined.

The solid content of the hollow polymer in the interlayer is preferably from 5 to 2000 parts by mass relative to 100 parts by mass of the solid content of the binder resin therein. The ratio by mass of the solid content of the hollow polymer to be in the coating liquid is preferably from 1 to 70% by mass, more preferably from 10 to 40% by mass. When the ratio of the hollow polymer is too small, then it could not give sufficient heat insulation; but if too large, the binding force of the hollow polymer to each other may lower, therefore causing problems of powder dropping or film peeling during treatment.

The particle size of the hollow polymer is preferably from 0.1 to 20 μm, more preferably from 0.1 to 2 μm, even more preferably from 0.1 to 1 μm. The glass transition temperature (Tg) of the hollow polymer is preferably not lower than 70° C., more preferably not lower than 100° C.

The thermal transfer image-receiving sheet of the invention does not contain an aqueous dispersion of a resin not resistant to an organic solvent, except the hollow polymer, in the heat-insulating layer. When the sheet contains a resin not resistant to an organic solvent (dye-fixable resin), then it is undesirable since the transferred image may be much blurred. This may be because, when the heat-insulating layer contains a dye-fixable resin and a hollow polymer, then the dye transferred and fixed on the receiving layer may move via the adjacent heat-insulating layer with time.

"Not resistant to an organic solvent" as referred to herein mans that the solubility in an organic solvent is at most 1% by mass, preferably at most 0.5% by mass. For example, the above-mentioned polymer latex falls in the scope of "resin not resistant to organic solvent".

Preferably, the heat-insulating layer contains the above-mentioned water-soluble polymer. Preferred compounds are the same as those mentioned in the above.

The amount of the water-soluble polymer to be added to the heat-insulating layer is preferably from 1 to 75% by mass of the entire heat-insulating layer, more preferably from 1 to 50% by mass.

Preferably, the heat-insulating layer contains gelatin. The ratio of gelatin to the coating liquid for the heat-insulating layer is preferably from 0.5 to 14% by mass, more preferably from 1 to 6% by mass. Also preferably, the coating amount of the hollow polymer in the heat-insulating layer is from 1 to 100 g/m$^2$, more preferably from 5 to 20 g/m$^2$.

Preferably, the thickness of the hollow polymer-containing heat-insulating layer is from 5 to 50 μm, more preferably from 5 to 40 μm.

(Underlayer)

An underlayer may be formed between the receiving layer and the heat-insulating layer. For example, a white background-controlling layer, a static charge-controlling layer, an adhesive layer and a primer layer may be formed. These layers may have the same constitutions as those in Japanese Patents 3585599 and 2925244.

(Support)

In the invention, preferably used is a waterproof support. The waterproof support does not absorb water and therefore prevents the receiving layer from deteriorating with time. The waterproof support includes, for example, coated paper and laminate paper.

A method for producing the thermal transfer image-receiving sheet of the invention is described below.

The thermal transfer image-receiving sheet of the invention is produced by forming the constitutive layers according to an ordinary coating method of roll coating, bar coating, gravure reverse coating or the like.

The thermal transfer image-receiving sheet of the invention may be produced by forming a receiving layer and a heat-insulating layer on a support by simultaneous multilayer coating.

In case where a multilayer-structured image-receiving sheet is fabricated, which comprises plural layers having plural different functions (foam layer, heat-insulating layer, interlayer, receiving layer) formed on a support, there are known some methods. For example, the constitutive layers are successively formed by coating, as in JP-A 2004-106283, 2004-181988, 2004-345267; or the layers are previously formed on separate supports, and they are laminated together. On the other hand, in the field of photography, for example, it is known that plural layers are simultaneously formed by Coating, whereby the producibility may be greatly improved. For example, known are a slide coating method and a curtain coating method, as described in U.S. Pat. Nos. 2,761,791, 2,681,234, 3,508,947, 4,457,256, 3,993,019; JP-A 63-54975, 61-278848, 55-86557, 52-31727, 55-142565, 50-43140, 63-80872, 54-54020, 5-104061, 5-127305, JP-B 49-7050, or in Edgar B. Cutoff, et al., "Coating and Drying Defects: Troubleshooting Operating Problems", John Wiley & Sons, 1995, pp. 101-103.

In the invention, the above-mentioned simultaneous multilayer coating technique is applied to production of a multilayer-structured image-receiving sheet, thereby greatly increasing the producibility and greatly reducing the occurrence of image defects.

In the invention, resin is the main ingredient of the plural constitutive layers. Preferably, the coating liquids for the layers are in the form of polymer latex. The solid content by mass of the resin as a latex in the coating liquid for the layers is preferably from 5 to 80%, more preferably from 20 to 60%. The mean particle size of the resin in the polymer latex is preferably at most 5 μm, more preferably at most 1 μm. If desired, the aqueous latex dispersion may contain a known additive such as surfactant, dispersant, binder resin.

In the invention, it is desirable that a laminate of plural layers is formed on a support according to the method described in U.S. Pat. No. 2,761,791, and then rapidly solidified. In case where a multilayer constitution is formed through resin solidification in one example, it is desirable that plural layers are formed on a support and then immediately heated. In case where the layer contains a binder capable of gelling at a low temperature, such as gelatin, it may be desirable that plural layers are formed on a support and the temperature is then immediately lowered.

In the invention, the coating amount of the coating liquid per one layer to constitute the multilayer constitution is preferably within a range of from 1 g/m$^2$ to 500 g/m$^2$, more preferably from 3 g/m$^2$ to 200 g/m$^2$, most preferably from 5 g/m$^2$ to 150 g/m$^2$. The number of the layers of the multilayer constitution may be 2 or more, and may be suitably selected. Preferably, the receiving layer is provided as the remotest layer from the support.

In image formation with the thermal transfer image-receiving sheet of the invention, the thermal transfer sheet (ink sheet) to be combined with the thermal transfer image-receiving sheet of the invention comprises a dye layer containing a diffusive transfer dye, formed on a support. Any desired ink sheet may be used herein. The method of applying heat energy in thermal transfer may be any known conventional method. For example, using a recording device such as thermal printer (e.g., Hitachi Is trade name, Video printer VY-100) the recording time may be controlled, and heat energy of from 5 to 166 mJ/mm$^2$ or so may be given to the sheet to fully attain the intended object.

For the thermal transfer image-receiving sheet of the invention, the support may be suitably selected. Depending on the type of the support selected for it, the thermal transfer image-receiving sheet of the invention may be in any form of cut sheets, rolls, cards, or sheets for producing transmissive originals. The invention is directed to any of these applications.

The invention is applicable to thermal transfer recording-type printers and copiers.

EXAMPLES

The invention is described in more detail with reference to the following Examples and Reference Examples. In Examples, the material used, its amount and the ratio, the details of the treatment and the treatment process may be suitably modified or changed not overstepping the scope of the invention. Accordingly, the invention should not be limitatively interpreted by the Examples mentioned below. Unless otherwise specifically indicated, part and % in Examples are all by mass.

(1) Fabrication of Ink Sheet:

A polyester film (Lumirror, trade name by Toray) having a thickness of 6.0 μm was used as a support film. A heat-resistant slip layer (thickness 1 μm) was formed on the back of the film, and yellow, magenta and cyan compositions mentioned below were applied to the surface of the film, each as a single color (dry coating amount, 1 g/m$^2$).

| Yellow composition: | |
|---|---|
| Dye (Macrolex Yellow 6G, trade name by Bayer) | 5.5 mas. pts. |
| Polyvinyl butyral resin (Eslec BX-1, trade name by Sekisui Chemical Industry) | 4.5 mas. pts. |
| Methyl ethyl ketone/toluene (1/1 by mass) | 90 mas. pts. |
| Magenta composition: | |
| Magenta dye (Disperse Red 60) | 5.5 mas. pts. |
| Polyvinyl butyral resin (Eslec BX-1, trade name by Sekisui Chemical Industry) | 4.5 mas. pts. |
| Methyl ethyl ketone/toluene (1/1 by mass) | 90 mas. pts. |
| Cyan composition: | |
| Cyan dye (Solvent Blue 63) | 5.5 mas. pts. |
| Polyvinyl butyral resin (Eslec BX-1, trade name by Sekisui Chemical Industry) | 4.5 mas. pts. |
| Methyl ethyl ketone/toluene (1/1 by mass) | 90 mas. pts. |

(2) Fabrication of Thermal Transfer Image-Receiving Sheet:

(Formation of Support)

Using a disc refiner, 50 parts by mass of LBKP (Laubholz (broadleaf tree) bleached kraft pulp) of acacia and 50 parts by mass of LBKP of aspen were beaten to a Canadian freeness of 300 ml to prepare a pulp slurry.

Next, to the above-obtained pulp slurry, added were 1.3%, relative to the pulp, of cation-modified starch (Nippon NSC's trade name, CAT0304L), 0.15% of anionic polyacrylamide (Seiko PMC's trade name; DA4104), 0.29% of alkylketene dimer (Arakawa Chemical's trade name, Sizepine K), 0.29% of behenylamide epoxide, and 0.32% of polyamide-polyamine-epichlorohydrin (Arakawa Chemical's trade name, Arafix 100), and then 0.12% of a defoaming agent was added thereto.

Using a Fourdrinier paper machine, the pulp slurry prepared in the manner as above was made into paper. In the step of drying the web by pressing its felt surface against a drum drier cylinder via a drier canvas, the tension of the drier canvas was set at 1.6 kg/cm, and the web was dried in that condition. Then, using a size press, polyvinyl alcohol (Kuraray's trade name, KL-118) was applied to both surfaces of the raw paper in an amount of 1 g/m$^2$, and dried, and then calendered. The papermaking condition was so controlled that the formed raw paper (base paper) could have a weight of 157 g/m$^2$ and a thickness of 160 μm.

The wire surface (back) of the obtained base paper was processed for corona discharge treatment. Next, using a melt extruder, a resin composition prepared by blending a high-density polyethylene having MFR (melt flow rate—the same shall apply hereunder): 16.0 g/10 min, density: 0.96 g/cm$^3$) (containing 250 ppm of hydrotalcite (Kyowa Chemical Industry's trade name, DHT-4A), and 200 ppm of secondary antioxidant (tris(2,4-di-tert-butylphenyl phosphite, Ciba Speciality Chemicals' trade name, Irgafos 168)), and a low-density polyethylene having MFR of 4.0 g/10 min and a density of 0.93 g/cm$^3$ in a blend ratio of 75/25 (by mass) was applied onto it to a thickness of 21 g/m$^2$, thereby forming a thermoplastic resin layer with a mat surface (the thermoplastic resin back face is hereinafter referred to as "back"). The thermoplastic resin layer on the back side was further processed for corona discharge treatment, and then an aqueous dispersion prepared by dispersing an antistatic agent, aluminium oxide (Nissan Chemical Industry's trade name, "Alumina Sol 100") and silicon dioxide (Nissan Chemical Industry's trade name, "Snowtex O") in water in a ratio by mass of 1/2, was applied onto it to a dry mass of 0.2 g/m$^2$. Next, the surface was processed for corona treatment, and using a melt extruder, a low-density polyethylene having MFR of 4.0 g/10 min and a density of 0.93 g/m$^3$ and containing 10% by mass of titanium oxide was applied onto it in an amount of 27 g/m$^2$, thereby forming a thermoplastic resin layer with a mirror surface.

(Preparation of Emulsion A)

An emulsified dispersion A was prepared according to the following process.

A compound EB-9 was dissolved in a high-boiling-point solvent (Solv-5) (42 g) and ethyl acetate (20 ml), and the solution was emulsified and dispersed in an aqueous 20 mass. % gelatin solution (250 g) containing sodium dodecylbenzenesulfonate (1 g), using a high-performance stirring emulsifying machine (dissolver), and water was added to it to prepare an emulsion A (380 g).

The amount of the compound EB-9 was so controlled that its amount could be 30 mmol in the emulsion A.

(EB-9)

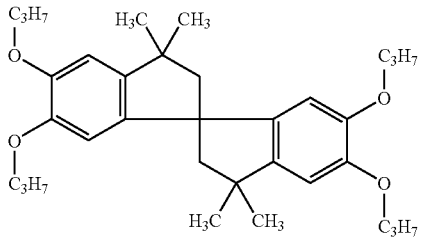

(Solv-5)

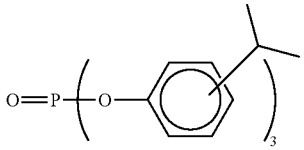

(Preparation of Emulsified Dispersion B)

A high-boiling-point solvent (Solv-5) (11.0 g), KF-96 (Shin-etsu Chemical's dimethylsilicone) (9 g), the above compound (EB-9) (15.5 g), KRYARAD DPCA-30 (by Nippon Kayaku) (7.5 g) and ethyl acetate (20 ml) were formed into a solution, and the solution was emulsified and dispersed in an aqueous 20 mass. % gelatin solution (250 g) containing sodium dodecylbenzenesulfonate (1 g), using a high-performance stirring emulsifying machine (dissolver). Water was added to it to prepare an emulsion B (380 g).

(Fabrication of Thermal Transfer Image-Receiving Sheets 101 to 112)

The surface of the support prepared in the manner was processed for corona discharge treatment, and then an undercoat layer 1, an undercoat layer 2, a heat-insulating layer and a receiving layer were formed on it by simultaneous multilayer coating in that order from the support. For simultaneous multilayer coating, the layers were formed by slide coating. After the coating, this was led to pass through a cooling zone at 8° C. for 35 seconds to remove its flowability, and then dry air at 22° C. and a relative humidity of 45% was applied on its surface for 2 minutes to dry it. The compositions of the coating liquids and their amount used are shown below.

Coating Liquid for undercoat layer 1 (coating amount, 11 ml/m$^2$)

(Composition)

This is an aqueous solution prepared by adding 1% of sodium dodecylbenzenesulfonate to an aqueous 3% gelatin solution. Its pH was controlled to 8 with NaCH.

Coating Liquid for undercoat layer 2 (coating amount, 11 ml)/m$^2$):

(Composition)

| | |
|---|---|
| Styrene-butadiene latex (Nippon A & L's SR103) | 60 mas. pts. |
| Polyvinyl alcohol (PVA) 6% aqueous solution | 40 mas. pts. |
| Fluorine-containing surfactant 1% aqueous solution | 2 mas. pts. |

Controlled at pH 8 with NaOH.

Coating Liquid 1 for heat-insulating layer (coating amount, 50 ml/m$^2$, viscosity of coating liquid, 44 cp)

(Composition)

| | |
|---|---|
| Emulsion A prepared above | 21 mas. pts. |
| Hollow polymer (Nippon Zeon's MH5055) | 48 mas. pts. |
| 10% gelatin aqueous solution | 27 mas. pts. |
| Water | 4 mas. pts. |

Additive shown in Table 1 as in Table 1

Controlled at pH 8.5 with NaOH.

(Coating Amount) 50 ml/m$^2$.

Coating Liquid 1 for receiving layer (coating amount, 18 ml/m$^2$, viscosity of coating liquid, 8 cp):

(Composition)

| | |
|---|---|
| Emulsion B prepared above | 4 mas. pts. |
| Vinyl chloride-acryl compound copolymer latex (Nisshin Chemical's Vinybran 900) | 54 mas. pts. |
| Vinyl chloride-acryl compound copolymer latex (Nisshin Chemical's Vinybran 276) | 9 mas. pts. |
| Microcrystalline wax (Nippon Seiro's EMUSTAR-42X) | 6 mas. pts. |
| Water | 22 mas. pts. |
| Fluorine-containing surfactant 1% aqueous solution | 4 mas. pts. |
| Mat agent (melamine-silica resin, Nissan Chemical Industry's trade name, Optobeads 3500M) | 1 mas. pt. |

Additive shown in Table 1 as in Table 1

Controlled at pH 8 with NaOH.

(3) Image Formation and Property Evaluation:

(Image Formation)

The ink sheet and the thermal transfer image-receiving sheets 101 to 112 were worked so as to be chargeable in printer. Using a sublimation-type thermal transfer printer, ASK2000 (by FUJIFILM), these were tested for rapid print mode image formation. In this, the time taken before the charging of the next sheet after the charging of the former sheet was 3 seconds. The outputted image was a gradation image changing from white to max gray (black solid).

(Property Evaluation)

The prints were evaluated for image failure as follows:

50 prints of continuous gradation image with from white to max gray (black solid) were continuously outputted, and 5 panelists checked them on the basis of the following criteria:

5: No image density unevenness found entirely in the gradation part of the image, with no problem in practical use.

4: Some but slight density unevenness found in the low density part of the image, but no problem in practical use.

3: Some density unevenness found from the low density part to the middle density part (density, about 1.0), and this was problematic in practical use.

2: Much density unevenness found from the low density part to the middle density part (density, about 1.0), and this was problematic in practical use.

1: Great density unevenness found in the entire area, and this was problematic in practical use.

TABLE 1

| | Additive to Heat-Insulating Layer | | Additive to Image-Receiving Layer | | Property |
|---|---|---|---|---|---|
| Sample | type | amount added (mas. pts.) | type | amount added (mas. pts.) | Density Unevenness |
| 101 (Comparative Example) | — | — | — | — | 2 |
| 102 (Comparative Example) | — | — | I-1 | 0.1 | 3 |
| 103 (Comparative Example) | I-1 | 0.2 | — | — | 2 |
| 104 (Comparative Example) | I-1 | 0.2 | I-1 | 0.1 | 3 |
| 105 (Comparative Example) | II-25 | 0.2 | II-25 | 0.1 | 3 |
| 106 (Comparative Example) | III-2 | 0.2 | III-2 | 0.1 | 2 |
| 107 (Comparative Example) | IV-3 | 0.2 | IV-3 | 0.1 | 3 |
| 108 (the Invention) | II-25<br>II-44 | 0.1<br>0.1 | II-25<br>II-44 | 0.05<br>0.05 | 5 |

TABLE 1-continued

| Sample | Additive to Heat-Insulating Layer type | Additive to Heat-Insulating Layer amount added (mas. pts.) | Additive to Image-Receiving Layer type | Additive to Image-Receiving Layer amount added (mas. pts.) | Property Density Unevenness |
|---|---|---|---|---|---|
| 109 | II-43 | 0.1 | II-43 | 0.05 | 5 |
| (the Invention) | II-44 | 0.1 | II-44 | 0.05 | |
| 110 | II-25 | 0.3 | II-25 | 0.15 | 4 |
| (the Invention) | IV-3 | 0.3 | IV-3 | 0.15 | |
| 111 | II-44 | 0.3 | II-44 | 0.15 | 4 |
| (the Invention) | III-2 | 0.3 | III-2 | 0.15 | |
| 112 | — | — | II-25 | 0.05 | 5 |
| (the Invention) | — | — | II-44 | 0.05 | |

As is obvious from Table 1, it is confirmed that adding at least two compounds of formulae [I] to [IV] to a thermal transfer image-receiving sheet according to the invention improves the surface condition of the sheet and the sheet gives high-quality image with little density unevenness.

The present disclosure relates to the subject matter contained in Japanese Patent Application No. 092502/2007 filed on Mar. 30, 2007, which is expressly incorporated herein by reference in its entirety. All the publications referred to in the present specification are also expressly incorporated herein by reference in their entirety.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention not be limited by the specification, but be defined claims set forth below.

What is claimed is:

1. A thermal transfer image-receiving sheet comprising a heat-insulating layer and an image-receiving layer on a support, wherein the receiving layer contains at least one polymer latex, the heat-insulating layer contains at least hollow polymeric particles, and at least two layers on the image-receiving layer side of the support are formed by simultaneous multilayer coating, and wherein at least one layer on the image-receiving layer side of the support contains at least two compounds of the following formulae [I] to [IV]:

[I]

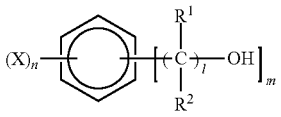

wherein $R^1$ and $R^2$ may be the same or different, each representing a hydrogen atom, a hydroxyl group, or a lower alkyl group; X represents a hydrogen atom, a halogen atom, a nitro group, a cyano group, an aryl group, a lower alkyl group, a lower alkenyl group, an aralkyl group, an alkoxy group, —$COR^3$, —$SO_2R^4$, or $N(R^5)R^6$; $R^3$ and $R^4$ may be the same or different, each representing a hydrogen atom, —OM, a lower alkyl group, a lower alkoxy group, or $N(R^7)R^8$;

$R^5$ and $R^6$ may be the same or different, each representing a hydrogen atom, a lower alkyl group, —$COR^9$, or $SO_2R^{10}$; $R^9$ and $R^{10}$ may be the same or different, each representing a lower alkyl group, or $N(R^{11})R^{12}$; $R^7$, $R^8$, $R^{11}$, and $R^{12}$ may be the same or different, each representing a hydrogen atom or a lower alkyl group;

M represents a hydrogen atom, an alkali metal atom, or an atomic group necessary for forming a monovalent cation; l indicates an integer of from 2 to 6; m indicates an integer of from 1 to 4; n is (6-m); and when the formula has plural $R^1$'s, $R^2$'s and X's, then they may be the same or different;

[II]

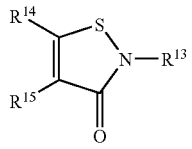

wherein $R^{13}$ represents a hydrogen atom, an alkyl group, an alkenyl group, an aralkyl group, an aryl group, a heterocyclic group,

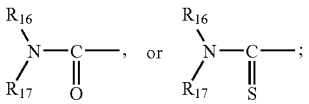

$R^{14}$ and $R^{15}$ may be the same or different, each representing a hydrogen atom, an alkyl group, an aryl group, a cyano group, a heterocyclic group, a halogen atom, a hydroxyl group, a sulfo group, an amino group, an alkylamino group, an acylamino group, an alkoxycarbonylamino group, an alkylthio group, an alkylsulfoxy group, or an alkylsulfonyl group; $R^{14}$ and $R^{15}$ may bond to each other to form an aromatic ring;

$R^{16}$ and $R^{17}$ may be the same or different, each representing a hydrogen atom, an alkyl group, an aryl group, or an aralkyl group;

[III]

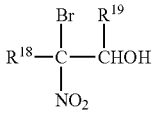

wherein $R^{18}$ represents a hydrogen atom, an alkyl group, or a hydroxymethyl group; $R^{19}$ represents a hydrogen atom, or an alkyl group;

[IV]

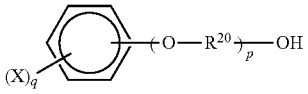

wherein $R^{20}$ represents a lower alkylene group; X represents a hydrogen atom, a halogen atom, a nitro group, a hydroxy group, a cyano group, a lower alkyl group, a lower alkoxy group, —$COR^{21}$, —$N(R^{22})R^{23}$, or —$SO_3M$; $R^{21}$ represents a hydrogen atom, —OM, a lower alkyl group, an aryloxy group, an aralkyl group, a lower alkoxy group, an aryloxy group, an aralkyloxy group, or —$N(R^{24})R^{25}$; $R^{22}$ and $R^{23}$ may be the same or different, each representing a hydrogen atom, a lower alkyl group, an aryl group, an aralkyl group, —$COR^{26}$, or —$SO_2R^{26}$; $R^{24}$ and $R^{25}$ may be the same or different, each representing a hydrogen atom, a lower alkyl group, an aryl group, or an aralkyl group; $R^{26}$ represents a lower alkyl group, an aryl group, or an aralkyl group; M represents a hydrogen atom, an alkali metal atom, or an atomic group necessary for forming a monovalent cation; p indicates 0 or 1; and q indicates an integer of from 0 to 5.

2. The thermal transfer image-receiving sheet according to claim 1, wherein the compounds are in plural layers on the image-receiving layer side of the support.

3. The thermal transfer image-receiving sheet according to claim 2, wherein the compounds are contained in two or more heat-insulating layers and two or more image-receiving layers.

4. The thermal transfer image-receiving sheet according to claim 1, wherein the heat-insulating layer comprises gelatin.

5. The thermal transfer image-receiving sheet according to claim 1, wherein the polymer latex contained in the receiving layer is a polyvinyl chloride.

6. The thermal transfer image-receiving sheet according to claim 1, wherein $R^{14}$ and $R^{15}$ may be the same or different, each representing a hydrogen atom, an alkyl group, an aryl group, a cyano group, a heterocyclic group, a hydroxyl group, a sulfo group, an amino group, an alkylamino group, an acylamino group, an alkoxycarbonylamino group, an alkylthio group, an alkylsulfoxy group, or an alkylsulfonyl group; and $R^{14}$ and $R^{15}$ may bond to each other to form an aromatic ring.

7. The thermal transfer image-receiving sheet according to claim 6, wherein $R^{14}$ and $R^{15}$ bond to each other to form an aromatic ring.

8. A method for applying a surface condition improver to a thermal transfer image-receiving sheet comprising an image-receiving layer on a support, comprising providing a surface condition improver containing at least two compounds of the following formula [I] to [IV] and applying it to the image-receiving layer side of a thermal transfer image-receiving sheet

[I]

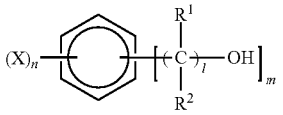

wherein $R^1$ and $R^2$ may be the same or different, each representing a hydrogen atom, a hydroxyl group, or a lower alkyl group; X represents, a hydrogen atom, a halogen atom, a nitro group, a cyano group, an aryl group, a lower alkyl group, a lower alkenyl group, an aralkyl group, an alkoxy group, —$COR^3$, —$SO_2R^4$, or $N(R^5)R^6$; $R^3$ and $R^4$ may be the same or different, each representing a hydrogen atom, —OM, a lower alkyl group, a lower alkoxy group, or $N(R^7)R^8$;

$R^5$ and $R^6$ may be the same or different, each representing a hydrogen atom, a lower alkyl group, —$COR^9$, or $SO_2R^{10}$; $R^9$ and $R^{10}$ may be the same or different, each representing a lower alkyl group, or $N(R^{11})R^{12}$; $R^7$, $R^8$, $R^{11}$ and $R^{12}$ may be the same or different, each representing a hydrogen atom or a lower alkyl group; M represents a hydrogen atom, an alkali metal atom, or an atomic group necessary for forming a monovalent cation; l indicates an integer of from 2 to 6; m indicates an integer of from 1 to 4; n is (6-m); and when the formula has plural $R^1$'s, $R^2$'s and X's, then they may be the same or different;

[II]

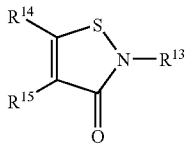

wherein $R^{13}$ represents a hydrogen atom, an alkyl group, an alkenyl group, an aralkyl group, an aryl group, a heterocyclic group,

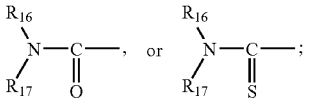

$R^{14}$ and $R^{15}$ may be the same or different, each representing a hydrogen atom, an alkyl group, an aryl group, a cyano group, a heterocyclic group, a halogen atom, a hydroxyl group, a sulfo group, an amino group, an alkylamino group, an acylamino group, an alkoxcarbonylamino group, an alkylthio group, an alkylsulfoxy group, or an alkylsulfonyl group; $R^{14}$ and $R^{15}$ may bond to each other to form an aromatic ring;

$R^{16}$ and $R^{17}$ may be the same or different, each representing a hydrogen atom, an alkyl group, an aryl group, or an aralkyl group;

[III]

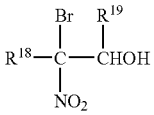

wherein $R^{18}$ represents a hydrogen atom, an alkyl group, or a hydroxymethyl group; $R^{19}$ represents a hydrogen atom, or an alkyl group;

[IV]

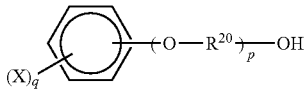

wherein $R^{20}$ represents a lower alkylene group; X represents a hydrogen atom, a halogen atom, a nitro group, a hydroxy group, a cyano group, a lower alkyl group, a lower alkoxy group, —$COR^{21}$, —$N(R^{22})R^{23}$, or —$SO_3M$; $R^{21}$ represents a hydrogen atom, —OM, a lower alkyl group, an aryl group, an aralkyl group, a lower alkoxy group, an aryloxy group, an aralkyloxy group, or —$N(R^{24})R^{25}$; $R^{22}$ and $R^{23}$ may be the same or different, each representing a hydrogen atom, a lower alkyl group, an aryl group, an aralkyl group, —$COR^{26}$, or —$SO_2R^{26}$; $R^{24}$ and $R^{25}$ may be the same or different, each representing a hydrogen atom, a lower alkyl group, an aryl group, or an aralkyl group; $R^{26}$ represents a lower alkyl group, an aryl group, or an aralkyl group; M represents a hydrogen atom, an alkali metal atom, or an atomic group necessary for forming a monovalent cation; p indicates 0 or 1; and q indicates an integer of from 0 to 5.

9. The method for applying a surface condition improver to a thermal transfer image-receiving sheet of claim 8, wherein $R^{14}$ and $R^{15}$ may be the same or different, each representing a hydrogen atom, an alkyl group, an aryl group, a cyano group, a heterocyclic group, a hydroxyl group, a sulfo group, an amino group, an alkylamino group, an acylamino group, an alkoxycarbonylamino group, an alkylthio group, an alkylsulfoxy group, or an alkylsulfonyl group; and $R^{14}$ and $R^{15}$ may bond to each other to form an aromatic ring.

10. The method for applying a surface condition improver to a thermal transfer image-receiving sheet of claim 8, wherein $R^{14}$ and $R^{15}$ bond to each other to form an aromatic ring.

* * * * *